US011790808B2

(12) United States Patent
Cho et al.

(10) Patent No.: US 11,790,808 B2
(45) Date of Patent: Oct. 17, 2023

(54) PEG HOOK LABEL APPARATUS

(71) Applicant: SOLUM CO., LTD., Yongin-si (KR)

(72) Inventors: Hyun Hun Cho, Hwaseong-si (KR); Yong Bum Lim, Yongin-si (KR); Mi Deum Choi, Suwon-si (KR); Sang Baek Park, Yongin-si (KR)

(73) Assignee: SOLUM CO., LTD., Yongin-si (KR)

( * ) Notice: Subject to any disclaimer, the term of this patent is extended or adjusted under 35 U.S.C. 154(b) by 0 days.

(21) Appl. No.: 17/391,965

(22) Filed: Aug. 2, 2021

(65) Prior Publication Data

US 2022/0036769 A1 Feb. 3, 2022

(30) Foreign Application Priority Data

Aug. 3, 2020 (KR) ..... 10-2020-0096755
Jul. 20, 2021 (KR) ..... 10-2021-0094664

(51) Int. Cl.
*G09F 3/20* (2006.01)
*G09F 3/16* (2006.01)
*A47F 5/08* (2006.01)

(52) U.S. Cl.
CPC ..... *G09F 3/208* (2013.01); *G09F 3/16* (2013.01); *A47F 5/0869* (2013.01)

(58) Field of Classification Search
CPC . G09F 3/16; G09F 3/208; G09F 23/06; G09F 3/204; A47F 5/0869
See application file for complete search history.

(56) References Cited

U.S. PATENT DOCUMENTS 5,088,606 A * 2/1992 Boas ..... A47F 5/0823 248/224.7
5,645,175 A * 7/1997 Wood ..... A47F 5/0869 211/59.1
5,718,340 A * 2/1998 Nagel ..... A47F 5/0869 211/59.1
5,946,839 A * 9/1999 Odmark ..... A47F 5/0869 24/3.12
6,269,571 B1 * 8/2001 Thalenfeld ..... A47F 5/0869 40/642.01
6,389,722 B1 * 5/2002 Josefsson ..... A47F 5/0869 40/658

(Continued)

FOREIGN PATENT DOCUMENTS

DE 202018107239 U1 3/2020
EP 3513687 A1 7/2019

(Continued)

OTHER PUBLICATIONS

European Search Report issued for corresponding EP Application No. 21188324.4, dated Dec. 9, 2021.

(Continued)

*Primary Examiner* — David R Dunn
*Assistant Examiner* — Christopher E Veraa
(74) *Attorney, Agent, or Firm* — Renner, Otto, Boisselle & Sklar, LLP

(57) ABSTRACT

A peg hook label apparatus includes a body provided with an electronic display unit displaying product information, and a holder provided on one end of the body and configured to have a first width in a portion connected to the body, the first width being greater than a second width of a locking hook disposed on an end portion thereof.

18 Claims, 14 Drawing Sheets

(56) References Cited

U.S. PATENT DOCUMENTS

| | | | | |
|---|---|---|---|---|
| 6,604,310 | B1 * | 8/2003 | Lindstrom | A47F 5/0869 40/642.01 |
| 2007/0051816 | A1 * | 3/2007 | Chu | G09F 9/30 235/492 |
| 2007/0224879 | A1 * | 9/2007 | Beilenhoff | A47F 5/0869 439/501 |
| 2011/0108691 | A1 * | 5/2011 | Alves | G09F 3/204 248/223.41 |
| 2019/0385490 | A1 * | 12/2019 | Stoop | G06F 3/147 |
| 2022/0036768 | A1 * | 2/2022 | Cho | G09F 9/30 |

FOREIGN PATENT DOCUMENTS

| | | | |
|---|---|---|---|
| JP | 2005/104647 | A | 4/2005 |
| KR | 10-2007-0034991 | | 3/2007 |
| KR | 10-1250261 | B1 | 4/2013 |
| KR | 10-2016-0086247 | A | 7/2016 |
| WO | 96/14630 | A1 | 5/1996 |
| WO | 99/27824 | A1 | 6/1999 |
| WO | 2014/160491 | A2 | 10/2014 |

OTHER PUBLICATIONS

Korean Office Action corresponding to counterpart application KR 10-2021-0094664, dated Oct. 20, 2022.

* cited by examiner

PEG HOOK LABEL APPARATUS

CROSS-REFERENCE TO RELATED APPLICATION(S)

This application claims the benefit under 35 USC 119 (a) of Korean Patent Application No. 10-2020-0096755 filed on Aug. 3, 2020 and Korean Patent Application No. 10-2021-0094664 filed on Jul. 20, 2021 in the Korean Intellectual Property Office, the entire disclosures of which are incorporated herein by reference for all purposes.

BACKGROUND

1. Field

The present disclosure relates to a peg hook label apparatus, and more particularly, to a peg hook label apparatus held on a peg hook to display product information.

2. Description of Related Art

In stores that sell various types of products in large quantities, such as department stores and large marts, numerous product shelves are installed, and various products organized by type are displayed and sold thereon.

On the front of the product shelf where respective products are displayed, labels that provide information such as the names and prices of products are attached, allowing consumers to purchase the product they want, and recently, electronic labels have been introduced to manage and display prices and information on various products through an electronic control device.

However, most of these labels are attached to shelves on which products are displayed. When a label is installed on a peg hook, a cantilever-type hanger, since the label may interfere with the operation of attaching the product to the peg hook, there is a limitation in that the operation may be inconvenient.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

An aspect of the present disclosure is to provide a peg hook label apparatus configured so as not to interfere with the work of placing a product on a peg hook.

According to an aspect of the present disclosure, a peg hook label apparatus includes a body provided with an electronic display unit displaying product information, and a holder provided on one end of the body and configured to have a first width in a portion connected to the body, the first width being greater than a second width of a locking hook disposed on an end portion of the holder.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
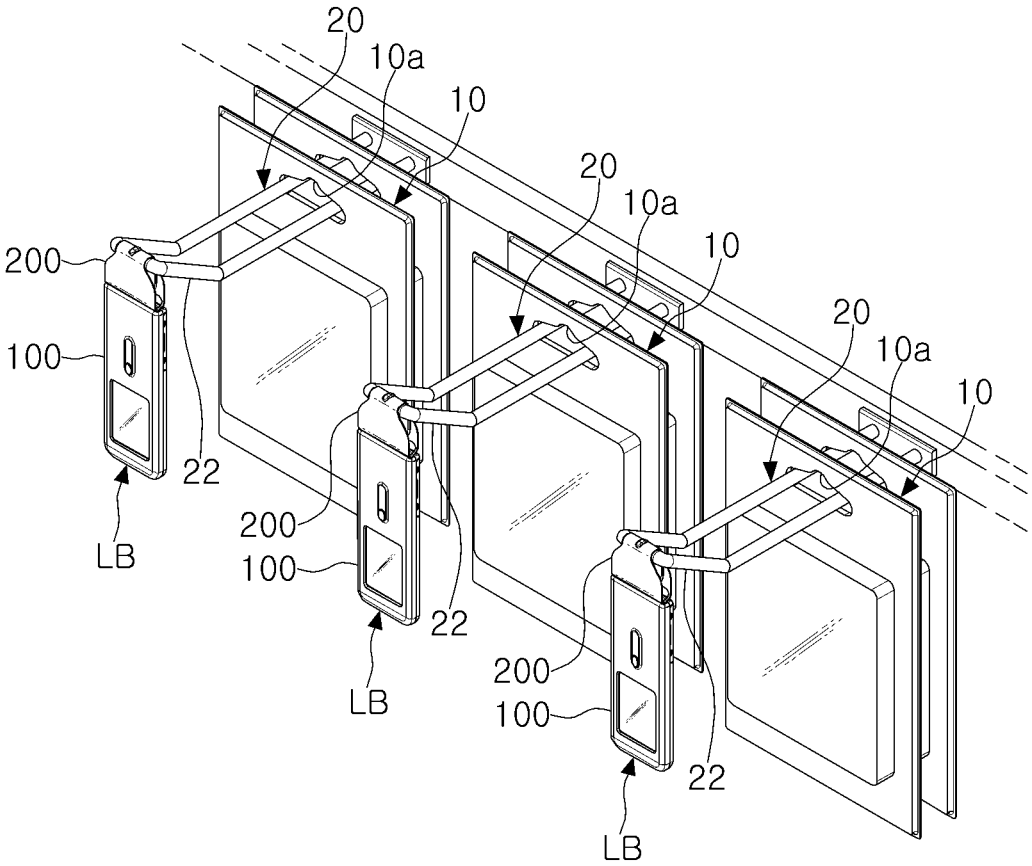
FIG. 1 is a drawing illustrating that a peg hook label apparatus according to an embodiment is hung on a peg hook on which a product is hung.

Hereinafter, exemplary embodiments will be described in detail with reference to the accompanying drawings so that those of ordinary skill in the art may easily implement the present disclosure. However, in describing an exemplary embodiment of the present disclosure in detail, if it is determined that a detailed description of a related known function or configuration may unnecessarily obscure the subject matter of the present disclosure, the detailed description thereof will be omitted. In addition, the same reference numerals are used throughout the drawings for portions having similar functions and functions. In addition, in this specification, terms such as 'on', 'upper', 'top', 'below', 'under', 'lower', and 'side' are based on drawings, and may vary depending on the direction in which elements or components are actually placed.

In addition, throughout the specification, when a part is said to be 'connected' to another part, it includes not only 'directly connected', but also 'indirectly connected' with another element in the middle. In addition, "including" a certain component means that other components may be further included rather than excluding other components unless specifically stated to the contrary.

Figure 2:
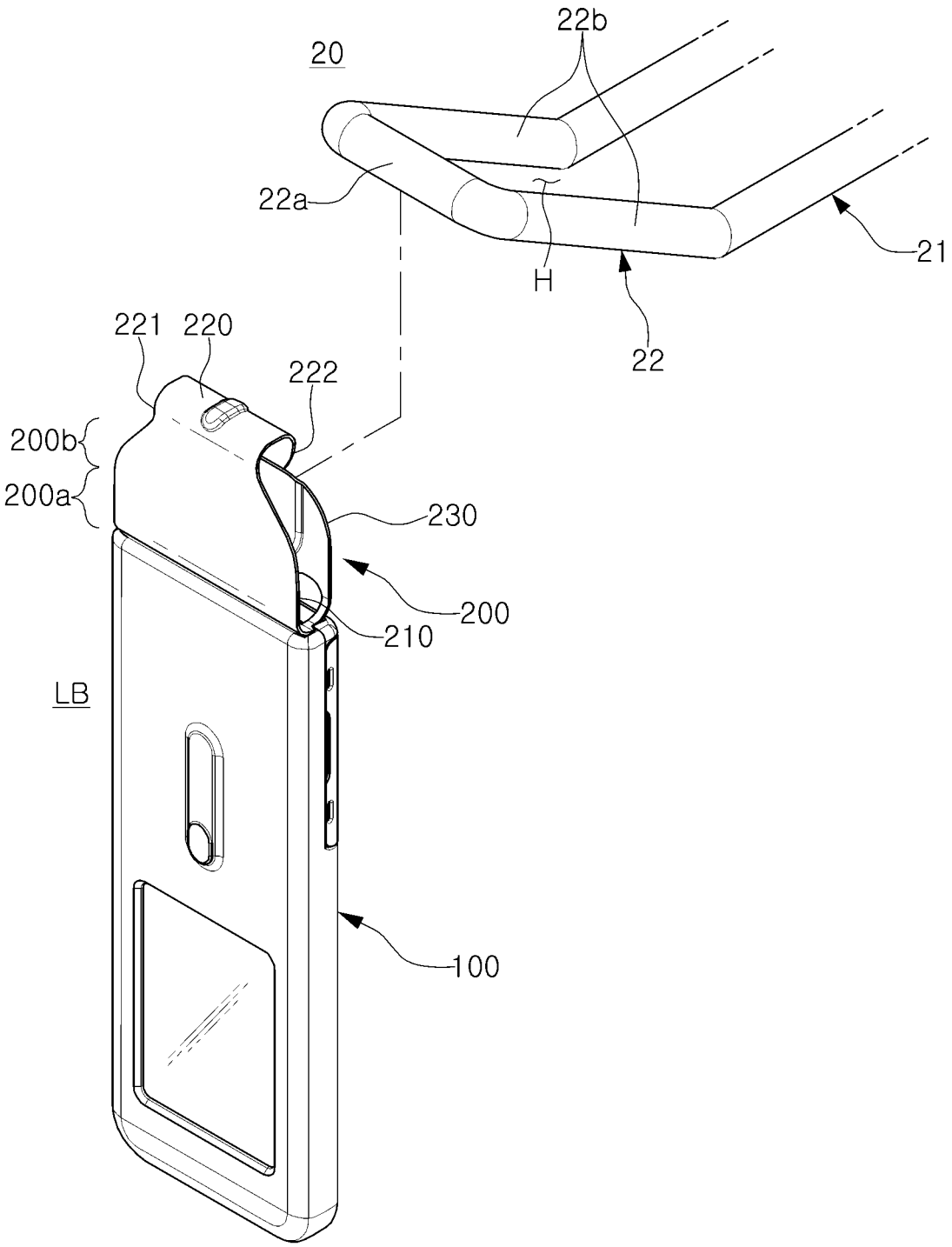
FIG. 2 is an enlarged view of the peg hook label apparatus of FIG. 1.

FIG. 1 is a view illustrating that a peg hook label apparatus according to an embodiment is hung on a peg hook on which a product is hung, and FIG. 2 is an enlarged view of the peg hook label apparatus of FIG. 1.

Figure 3:
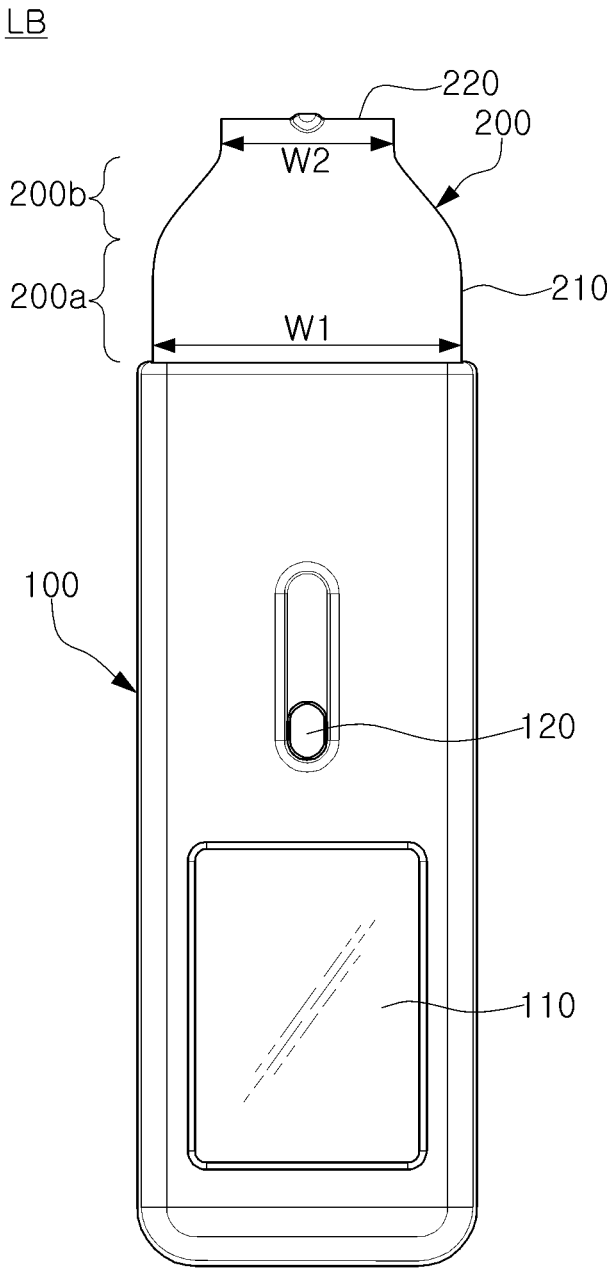
FIGS. 3 and 4 are front and rear views illustrating the peg hook label apparatus of FIG. 2.
Figure 4:
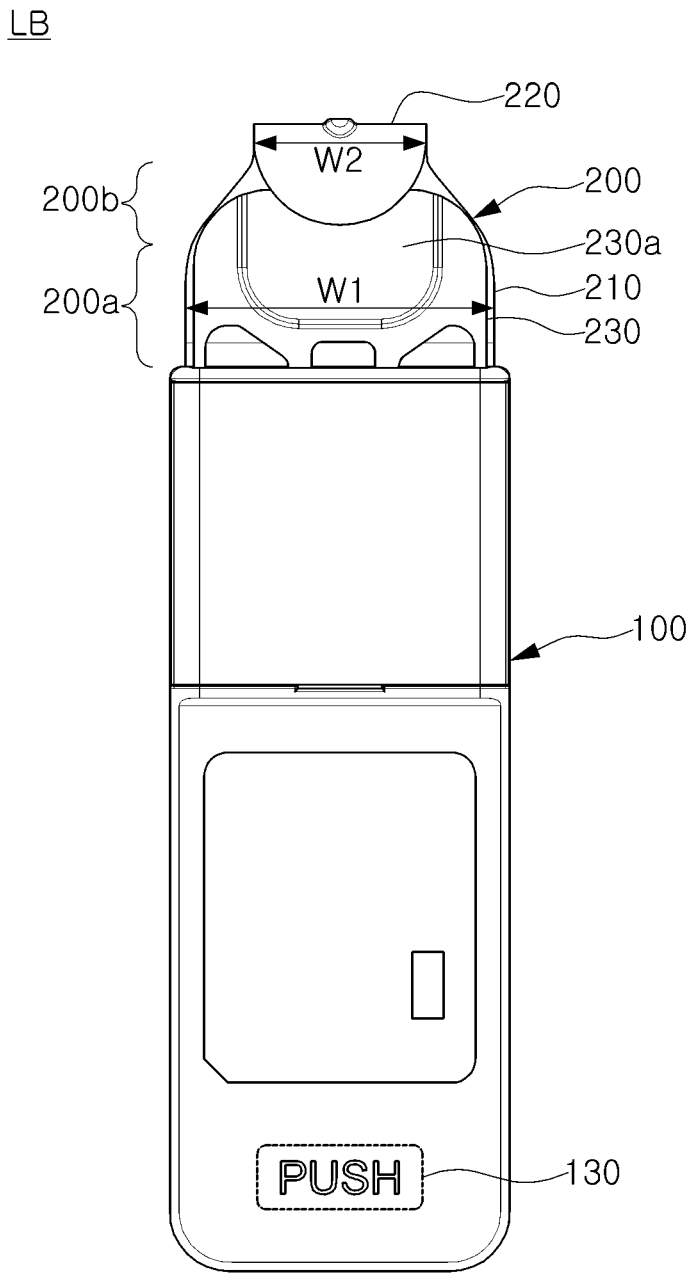
Figure 5:
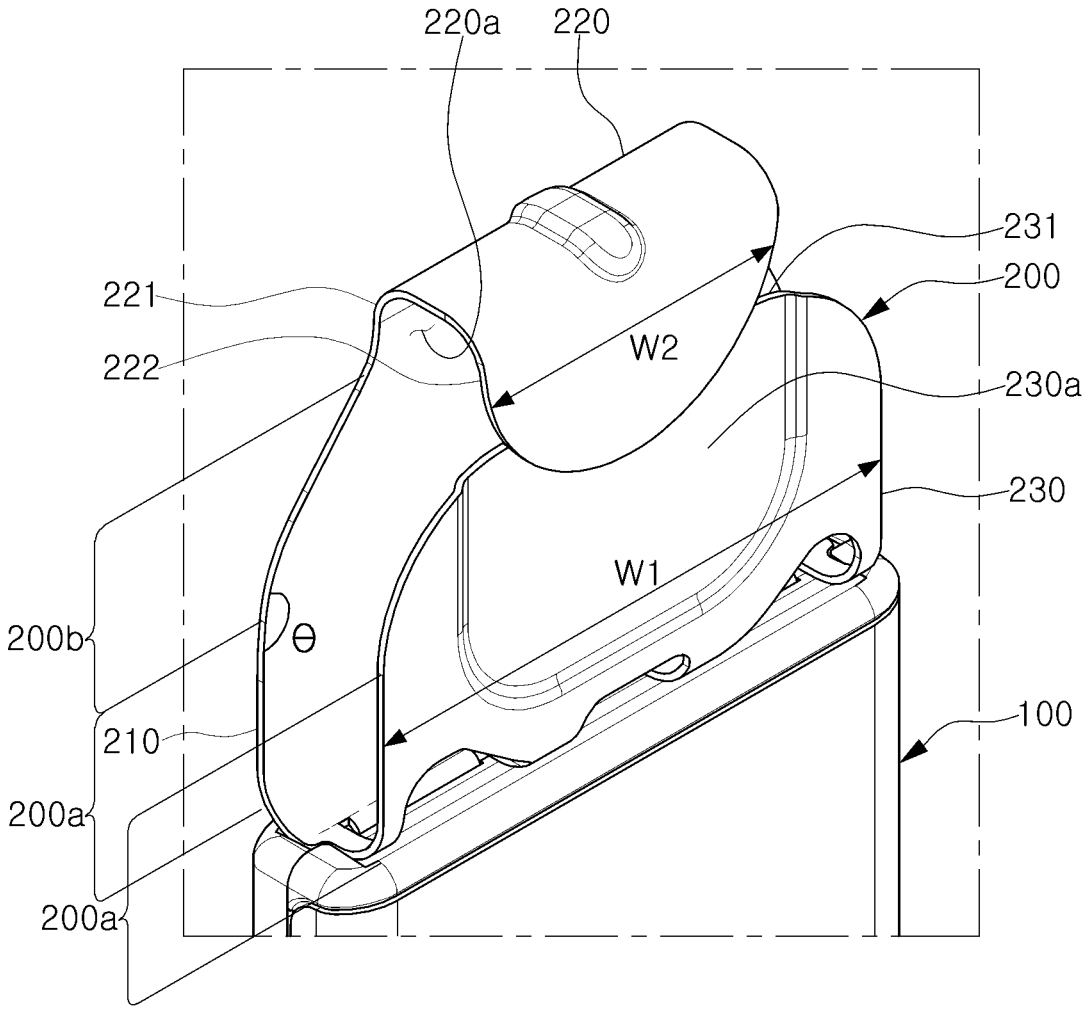
FIGS. 5 and 6 are enlarged views of a holder disposed on an upper portion in the peg hook label apparatus of FIG. 2.
Figure 6:
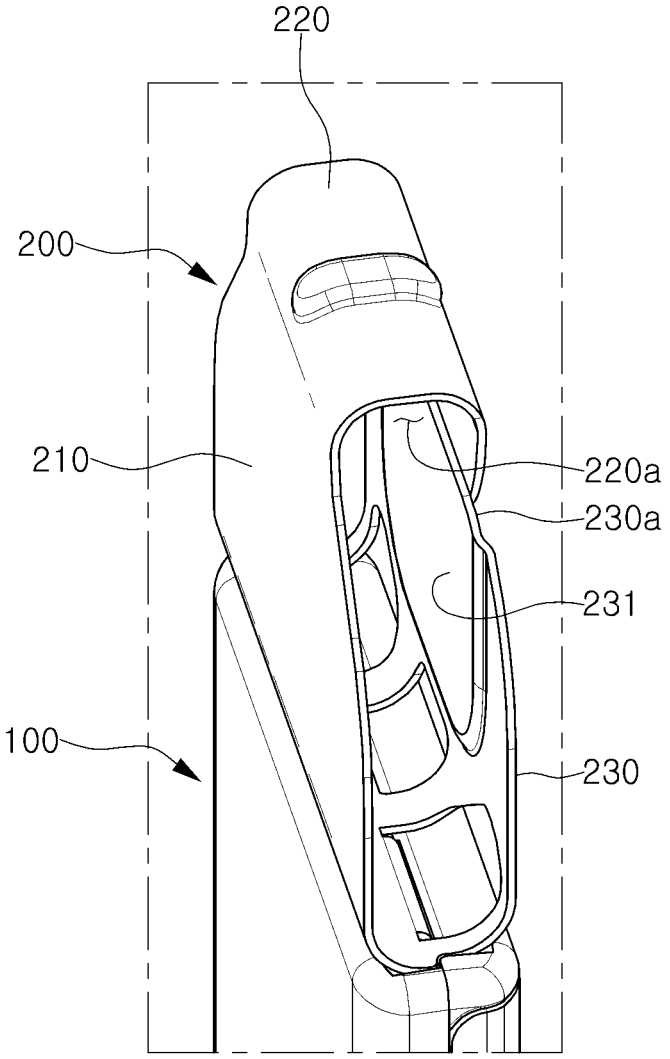

In addition, FIGS. 3 and 4 are front and rear views illustrating the peg hook label apparatus of FIG. 2, and FIGS. 5 and 6 are enlarged views of a holder disposed on an upper portion in the peg hook label apparatus of FIG. 2.

Referring to the drawings, a peg hook label apparatus LB according to an embodiment includes a body 100 and a holder 200.

The body 100 includes an electronic display unit 110 on which information on a product 10 is displayed.

In this case, the display unit 110 is formed on the front of the body 100, and is a portion in which the name and specific information of the product 10 are electronically displayed.

In the case of the display unit 110, any display unit in which the information of the product 10 may only be electronically displayed may be used, and thus, the display unit 110 is not limited to a specific configuration. Any configuration such as an electronic display may be used.

The holder 200 is installed and fixed on the upper portion of the body 100, and in this case, as illustrated in FIG. 1, the upper portion of the body 100 refers to the upper portion of the body 100 in a state in which the peg hook label apparatus LB is held by a peg hook 20 to be disposed in a longitudinal direction.

This holder 200 is configured to be held on an end portion 22 of the peg hook 20.

In this case, the peg hook 20 has a cantilever structure in which one end is fixed and the other end is not supported, in detail, a structure in which one end is connected and fixed to a wall or a vertically-disposed frame (not illustrated and the other end is not supported by other members.

The end portion 22 of the peg hook 20 to be described later refers to the other end that is not supported by other members and to a portion first inserted into a locking hole 10*a* of the product 10 for the product 10 to be held on the peg hook 20.

The end portion 22 of the peg hook 20 has a U-shape when viewed in plan view, and is disposed in a transverse direction. In more detail, the end portion 22 of the peg hook 20 has a dispositional structure in which it is bent from a body 21 of the peg hook 20 and inclined upwardly by a certain degree.

In detail, in this specification, the end portion 22 of the peg hook 20 is comprised of a horizontal bar 22*a*, which is formed on an end thereof and on which a locking hook 220 is held, and two sidebars 22*b* extending from both ends of the horizontal bar 22*a* as illustrated in FIG. 2. In this case, a central hole H of the end portion 22 of the peg hook 20 refers to a space between the two sidebars 22*b*.

The traversal arrangement structure of the end portion 22 of the peg hook 20 refers to a structure disposed to be inclined slightly upwardly, for example in this specification, refers to a lateral extension structure in a broad sense, including an inclined portion, except that the traversal arrangement structure is disposed vertically.

In detail, as illustrated in FIGS. 2 to 6, the holder 200 is configured to be rotatable by being connected to the end portion 22 of the peg hook 20 on which the product 10 is held, and is configured to be able to be fixed and released from the fixed position at the same angle as the inclination of the end portion 22 of the peg hook 20 by a reciprocating movement with respect to the peg hook 20.

The holder 200 may include a locking plate 210 that is a portion 200*a* connected to the body 100, and a support plate 230.

The locking plate 210 is disposed upwardly from one side of an upper portion of the body 100, and in detail, has a structure parallel to one surface of the body 100.

The locking hook 220 is formed extending from an upper end portion of the locking plate 210, and constitutes a rotatable structure by being held by the horizontal bar 22*a* of the peg hook 20.

In this case, the locking hook 220 has an inverted U-shape in which the upper portion is curved and the lower portion is open, and the horizontal bar 22*a* of the peg hook 20 is inserted through the open lower portion, such that the locking hook 220 may be held on the horizontal bar 22*a* of the peg hook 20.

When only the horizontal bar 22*a* of the peg hook 20 is inserted into the inner side of the locking hook 220, the locking hook 220 may be rotated while being held by the horizontal bar 22*a* of the peg hook 20.

For example, an inner space 220*a* of the locking hook 220 is a space having a longitudinal cross-sectional area larger than a longitudinal cross-sectional area of the horizontal bar 22*a* of the peg hook 20. In this case, even in the case in which the horizontal bar 22*a* of the peg hook 20 is inserted, the inner space 220*a* of the locking hook 220 may allow the horizontal bar 22*a* of the peg hook 20 to be prevented from being pressed by the inner surface of the locking hook 220. Therefore, the locking hook 220 may be rotated around the horizontal bar 22*a* of the peg hook 20.

In this case, the holder 200 may include an intermediate portion 200*b* between the portion 200*a* connected to the body 100 and the locking hook 230. For example, as illustrated in the drawing, the intermediate portion 200*b* may be formed between the locking plate 210 and the locking hook 230.

In this case, the holder 200 may be formed to have a tapered shape, and to this end, the side surface of the intermediate portion 200*b* has a structure inclined at 90 degrees or more and less than 180 degrees with respect to the side surface of the portion 200*a* connected to the body 100.

For example, as illustrated in FIG. 5, an angle θ between a side surface of the intermediate portion 200*b* and a side surface of the portion 200*a* connected to the body 100 may be selected in a range of 90 degrees or more and less than 180 degrees.

The support plate 230 is disposed upwardly from the other side of an upper portion of the body 100, and in detail, has a structure parallel to the other surface opposing one surface of the body 100. In this case, the locking plate 210 and the support plate 230 may be disposed in parallel.

When the end portion 22 of the peg hook 20 is inserted between the support plate 230 and the locking plate 210, the holder 200 may be fixed to the end portion 22 of the peg hook 20.

In this manner, as well as the horizontal bar 22*a* of the peg hook 20, the end portion 22 of the peg hook 20 including the same is inserted between the locking plate 210 and the support plate 230, such that the end portion 22 of the peg hook 20 is inserted and fixed between the locking plate 210 and the support plate 230.

For example, the horizontal bar 22*a* of the peg hook 20 has a rod shape and thus, may not be fixed even in the case of being inserted between the locking plate 210 and the support plate 230, such that the holder 200 may be rotated, while, in the case of the end portion 22 of the peg hook 20 having a U-shaped shape, the upper and lower surfaces of the end portion 22 are in close contact with the locking plate 210 and the support plate 230 when inserted between the locking plate 210 and the support plate 230, and thus, the holder 200 is not rotated and the position thereof is fixed.

To this end, the holder 200 may be configured in such a manner that a first width W1 of a portion 200*a* (the portion formed of the locking plate 210 and the support plate 230) connected to the body 100 is greater than a width W2 of the locking hook 220 formed on an end thereof.

In detail, the first width W1 may have a size that is greater than 1 times and less than 2 times or equal to the second width W2 as illustrated in the drawing.

In this specification, as the first width W1 refers to the width of the locking plate 210 or the width of the support plate 230, the width of each of the locking plate 210 and the support plate 230 is also indicated by reference numeral W1.

Figure 7:
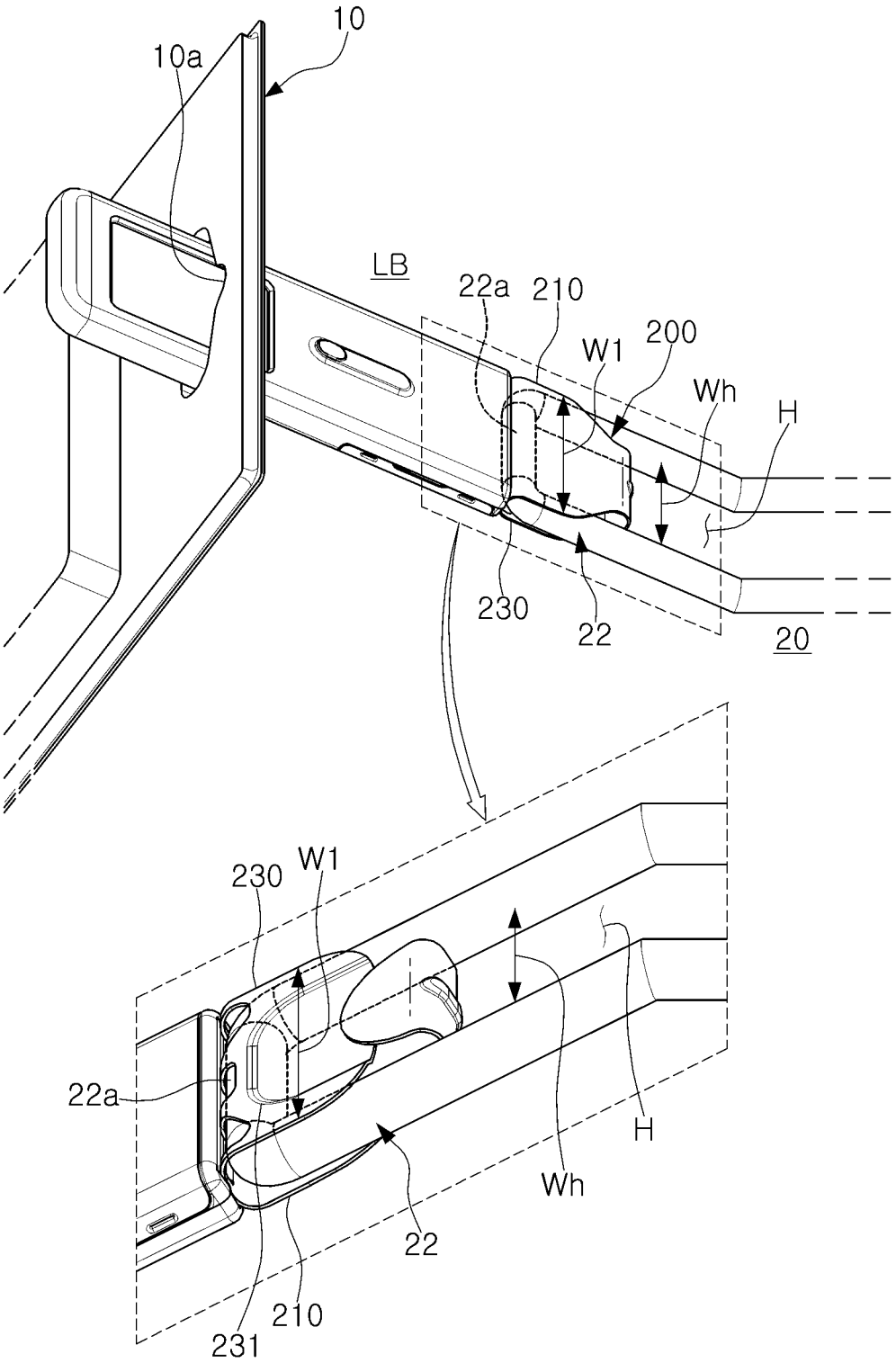
FIG. 7 is a view illustrating that the peg hook label apparatus of FIG. 2 is fixed at the same angle as an inclination of an end portion of a peg hook.

In detail, as illustrated in FIG. 7, to block rotation of the holder 200 when the end portion 22 of the peg hook 20 is inserted between the locking plate 210 and the support plate 230 after the holder 200 rotates at the same angle as the inclination of the end portion o22 of the peg hook 20; the first width W1 of the locking plate 210 and the support plate 230, which are parts connected to the body 100, may be formed to be greater than the second width W2 of the locking hook 220. Therefore, the first width W1 may be formed to be greater than a width Wh of an inner central hole H of the end portion 22 of the U-shaped peg hook 20.

In more detail, the first width W1 of the locking plate 210 and the support plate 230 connected to the body 100 is greater than the width Wh of the inner central hole H of the end portion 22 of the U-shaped peg hook 20. Therefore, in this case, when the body 100 of the peg hook label apparatus LB tries to rotate counterclockwise around the horizontal bar 22*a* of the peg hook 20, rotation is blocked by the support plate 230 of the holder 200 in close contact with a lower surface of the end portion 22 of the peg hook 20. Further, when the body 100 of the peg hook label apparatus LB tries to rotate clockwise around the horizontal bar 22*a* of the peg hook 20, the rotation is blocked by the locking plate 210 of the holder 200 in close contact with an upper surface of the end portion 22 of the peg hook 20.

In detail, when the body 100 of the peg hook label apparatus LB tries to rotate counterclockwise around the horizontal bar 22*a* of the peg hook 20, both side portions of the support plate 230 are held by the sidebars 22*b* of the peg hook 20 to block rotation. When the body 100 of the peg hook label apparatus LB tries to rotate clockwise around the horizontal bar 22*a* of the peg hook 20, both side portions of the locking plate 210 are held by the sidebars 22*b* of the peg hook 20 to block rotation.

Although not illustrated in the drawing, if the width W1 of the support plate 230 of the holder 200 in close contact with the lower surface of the end portion 22 of the peg hook 20 is not greater than the width Wh of the inner central hole H of the end portion 22 of the U-shaped peg hook 20, the support plate 230 passes upwardly through the central hole H of the end portion 22 of the U-shaped peg hook 20 in the case in which the body 100 receives external force from the upper side, and thus, the body 100 of the peg hook label apparatus LB is rotated counterclockwise around the horizontal bar 22*a* of the peg hook 20.

In addition, although not illustrated in the drawing, if the width W1 of the locking plate 210 of the holder 200 in close contact with the upper surface of the end portion 22 of the peg hook 20 is not greater than the width Wh of the inner central hole H of the end portion 22 of the U-shaped peg hook 20, the locking plate 210 passes downwardly through the central hole H of the end portion 22 of the U-shaped peg hook 20 in the case in which the body 100 receives external force from the lower side, and thus, the body 100 of the peg hook label apparatus LB rotates clockwise around the horizontal bar 22*a* of the peg hook 20.

Therefore, in the case of an embodiment of the present disclosure as described above, a structure in which the end portion 22 of the peg hook 20 is inserted and fixed between the locking plate 210 and the support plate 230 is provided, such that the holder 200 may reciprocate with respect to the peg hook 20 side, and therefore, the position thereof may be fixed at the same angle as the inclination of the end portion 22 of the peg hook 20, and the fixed position may be released.

In detail, when the holder 200 moves toward the peg hook 20, the end portion 22 of the peg hook 20 moves to between the locking plate 210 and the support plate 230, so that the position of the holder 200 is fixed at the same angle as the inclination of the end portion 22 of the peg hook 20, and when the holder 200 moves to the opposite side of the peg hook 20, the end portion 22 of the peg hook 20 deviates from between the locking plate 210 and the support plate 230, and thus, the holder 200 is released from the fixed position at the same angle as the inclination of the end portion 22 of the peg hook 20.

On the other hand, a process in which the peg hook label apparatus LB according to an embodiment is fixed to the end portion 22 of the peg hook 20 will be described with reference to FIGS. 8 and 9 as follows.

Figure 8:
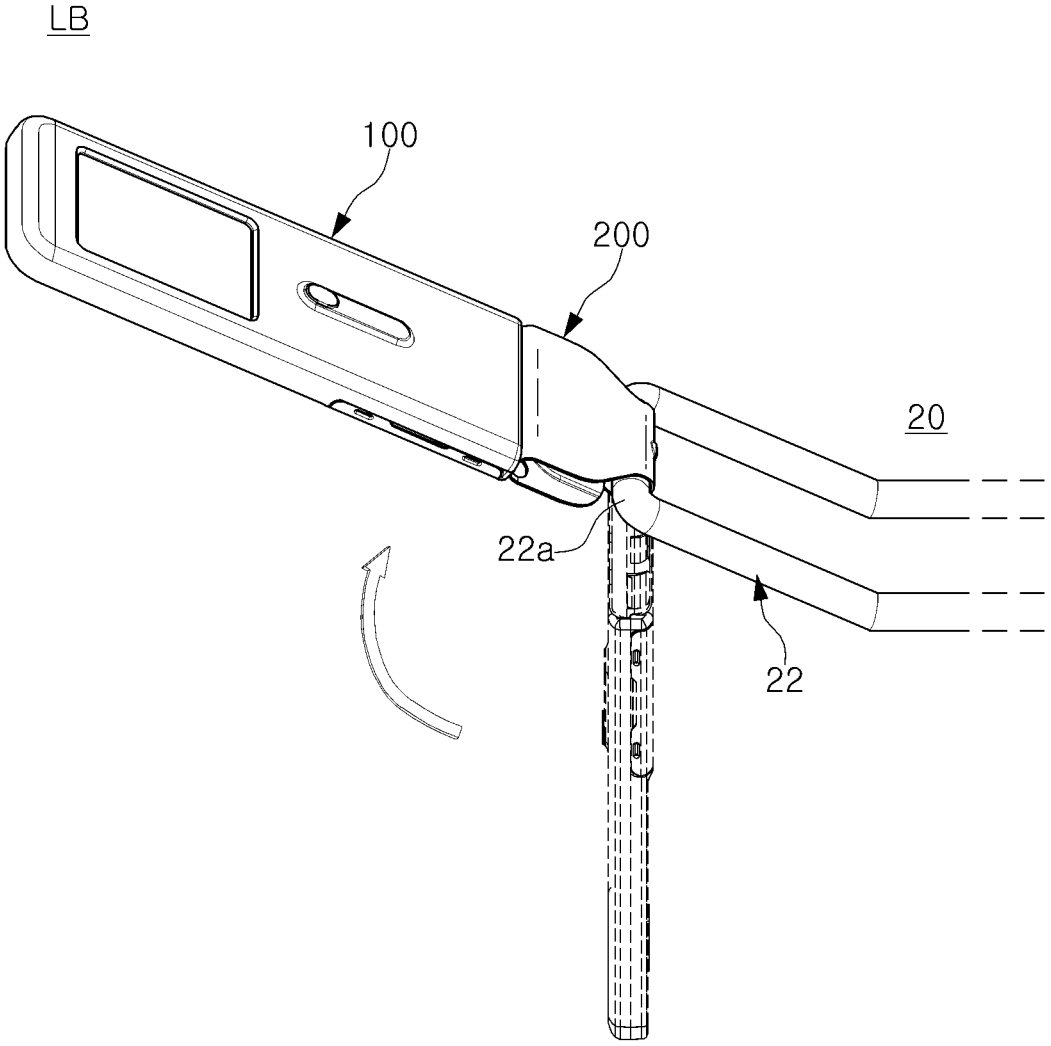
FIGS. 8 and 9 are views illustrating a process in which the peg hook label apparatus of FIG. 2 is fixed at the same angle as the inclination of the end portion of the peg hook as in the peg hook label apparatus of FIG. 7.

First, in a state in which the peg hook label apparatus LB is held on the horizontal bar 22*a* of the peg hook 20 to be disposed vertically, the operator holds and rotates the body 100 as illustrated in FIG. 8, in such a manner that the holder 200 has the same inclination as the end portion 22 of the peg hook 20.

Figure 9:
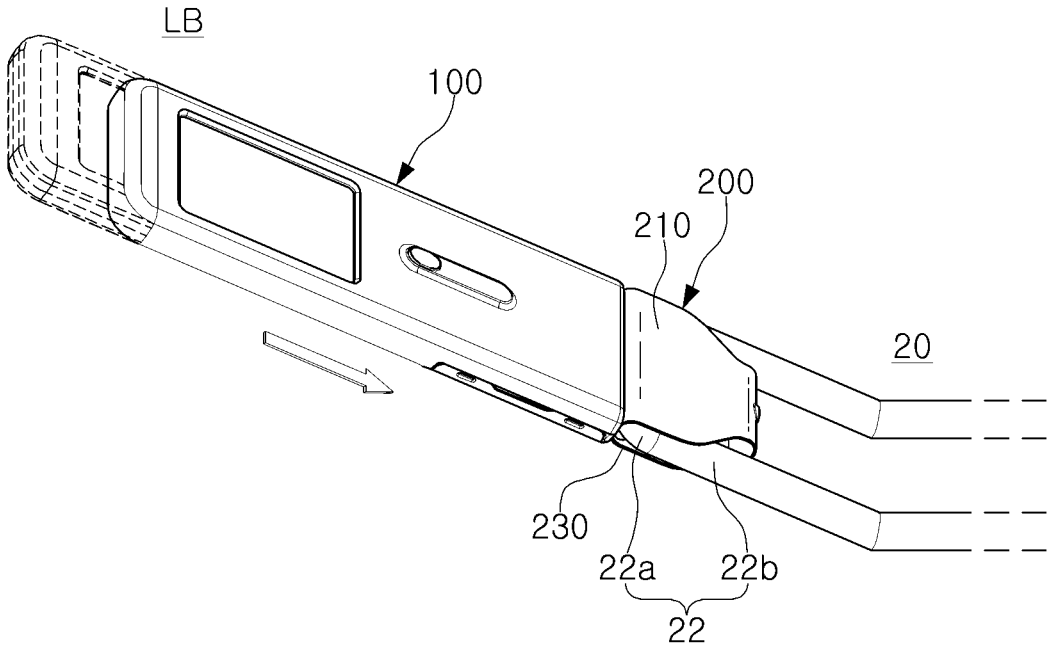

Next, as illustrated in FIG. 9, the operator pushes the body 100 to move toward the peg hook 20, such that the holder 200 is fixed to the end portion 22 of the peg hook 20 to fix the position thereof.

In detail, when the body 100 moves toward the peg hook 20, the end portion 22 of the peg hook 20 moves to between the locking plate 210 and the support plate 230, for example, the sidebars 22*b* are also inserted together with the horizontal bar 22*a* of the U-shaped peg hook 20, to between the locking plate 210 and the support plate 230. Therefore, upper and lower surfaces of the end portion 22 of the peg hook 20 are supported by the locking plate 210 and the support plate 230, such that the rotation of the holder 200 is blocked.

In this manner, the holder 200 is fixed in position at the same angle as the inclination of the end portion 22 of the peg hook 20, and thus, the body 100 to which the holder 200 is installed and fixed is also fixed in position, so that the product 10 may be smoothly and easily hung on the peg hook 20.

For example, as illustrated in FIG. 7, when the operator moves the product 10 so that the peg hook label apparatus LB is inserted into the locking hole 10*a* of the product 10; the end portion 22 of the peg hook 20 disposed at the same angle may also be smoothly and easily moved thereafter, such that the product 10 may be easily hung on the peg hook 20.

Further, after the engagement of the product 10 with respect to the peg hook 20 is completed as described above, the operator holds the body 100 and pulls the body to the opposite side of the peg hook 20 to move the body in the reverse direction, such that the fixed position of the holder 200 is released from the end portion 22 of the peg hook 20.

In detail, when the body 100 moves to the opposite side of the peg hook 20, the end portion 22 of the peg hook 20 comes out between the locking plate 210 and the support plate 230, and the horizontal bar 22*a* of the peg hook 20 moves to the inner space 220*a* of the locking hook 220, thereby providing a structure in which the locking hook 220 is held by the horizontal bar 22*a* of the peg hook 20. Therefore, the holder 200 is rotatable on the horizontal bar 22*a* of the peg hook 20.

Accordingly, the peg hook label apparatus LB is automatically rotated downward by the self-weight and is vertically disposed, so that the display unit 110 on which the information of the product 10 is displayed returns to an original state thereof to face the front.

On the other hand, the holder 200 has a separation distance between both inner side surfaces of a portion (a portion comprised of the locking plate 210 and the support plate 230) connected to the body 100, the separation distance being less than a separation distance between both inner side surfaces of the locking hook 220 formed on the end thereof.

For example, the locking hook 220 includes a first portion 221 adjacent to the locking plate 210 and a second portion 222 adjacent to the support plate 230, and in this case, the first portion 221 and the second portion 222 may be disposed facing each other, and a separation distance between the first portion 221 and the second portion 222 may be formed greater than the separation distance between the locking plate 210 and the support plate 230.

In detail, the holder 200 may have a structure in which at least a portion thereof protrudes from at least one of both inner side surfaces of the portion 200*a* connected to the body 100.

For example, at least one of the locking plate 210 and the support plate 230 has a protrusion 231 protruding from an inner surface thereof.

As an example, the protrusion 231 may be formed on the inner surface of the support plate 230. In this case, the locking hook 220 may extend to the protrusion 231 to be in contact with the protrusion 231.

The distance between the locking plate 210 and the support plate 230 is formed to be substantially equal to the thickness of the horizontal bar 22*a* of the peg hook 20, such that the horizontal bar 22*a* of the peg hook 20 is easily inserted therebetween. In this case, by the structure in which the protrusion 231 of the support plate 230 protrudes toward the locking plate 210, the distance between the locking plate 210 and the protrusion 231 may be formed to be less than the thickness of the horizontal bar 22*a* of the peg hook 20. Thus, when the horizontal bar 22*a* of the peg hook 20 is inserted between the locking plate 210 and the protrusion 231, the horizontal bar 22*a* of the peg hook 20 has a structure that is forcibly fitted between the locking plate 210 and the protrusion 231.

In this case, the locking plate 210 and the support plate 230 have a thin plate structure and may serve as a plate spring as they are bent to a certain degree. In the case in which the horizontal bar 22*a* of the peg hook 20 is forcibly fitted between the locking plate 210 and the protrusion 231, the locking plate 210 and the protrusion 231 are bent away from each other by the horizontal bar 22*a* of the peg hook 20 and have the force to restore again, and thus, elastically press the horizontal bar 22*a* of the peg hook 20.

Accordingly, when the holder 200 rotates at the same angle as the inclination of the end portion 22 of the peg hook 20 and the holder 200 then moves toward the peg hook 20, for example, when the horizontal bar 22*a* of the peg hook 20 is inserted between the locking plate 210 and the support plate 230, the horizontal bar 22*a* of the peg hook 20 is held or elastically pressed by the protrusion 231 protruding toward the locking plate 210.

In detail, as illustrated in FIG. 7, by the structure in which the protrusion 231 is only formed from the end of the support plate 230 inwardly by a certain degree, when the horizontal bar 22*a* of the peg hook 20 is inserted between the locking plate 210 and the support plate 230 and then is moved to an innermost side between the locking plate 210 and the support plate 230, the horizontal bar 22*a* of the peg hook 20 is held by the protrusion 231 such that the horizontal bar 22*a* does not again easily escape from between the locking plate 210 and the support plate 230.

In addition, in this case, the horizontal bar 22*a* of the peg hook 20 may be elastically pressed by the end of the protrusion 231 on the body 100 side, such that the horizontal bar 22*a* of the peg hook 20 may not escape in the reverse direction. Furthermore, when the horizontal bar 22*a* of the peg hook 20 is inserted between the locking plate 210 and the support plate 230, even in a case in which it is not moved to the innermost side between the locking plate 210 and the support plate 230, as the protrusion 231 elastically compresses the horizontal bar 22*a* of the peg hook 20, the holder 200 may be fixed in position.

As described above, when the holder 200 is moved toward the peg hook 20 to be fixed to the end portion 22 of the peg hook 20 after the holder 200 rotates at the same angle as the inclination of the end portion 22 of the peg hook 20; the protrusion 231 serves to further increase the fixing force, so that the fixed position may not be easily released even when external force is applied to the peg hook label apparatus LB in the process of hanging the production the peg hook 20.

Of course, in an embodiment of the present disclosure, the protrusion 231 only needs to be configured to elastically press the horizontal bar 22*a* of the peg hook 20, and the formation position may be changed. Although not illustrated in the drawing, as another example, the protrusion 231 may be formed on the inner surface of the locking plate 210 instead of the inner surface of the support plate 230, and furthermore, may also be formed on both the inner surface of the support plate 230 and the inner surface of the locking plate 210.

For reference, the holder 200 may be formed of a stainless steel material, and the holder 200 formed of a stainless steel material may have strong durability with elastic force to elastically press the end portion of the peg hook 20 to be fixed thereto.

In addition, a guide groove 230*a* may be formed on an outer surface of the support plate 230.

For example, by the protrusion 231, the outer surface of the support plate 230 has the guide groove 230*a* recessed therefrom.

In detail, by the protrusions 231 protruding from the inner surface of the support plate 230, the guide groove 230*a* recessed inwardly from the outer surface is formed on the outer surface of the support plate 230.

The guide groove 230*a* serves to guide the horizontal bar 22*a* of the peg hook 20 to be drawn into the inside of the locking hook 220.

To engage the locking hook 220 on the horizontal bar 22*a* of the peg hook 20, the horizontal bar 22*a* of the peg hook 20 is in contact with the support plate 230 of the locking hook 220 and is raised upwardly while pushing the support plate 230, to be introduced into the inner space 220*a* of the locking hook 220.

For example, the horizontal bar 22*a* of the peg hook 20 is inserted into the guide groove 230*a* that is formed from the support plate 230 toward the locking hook 220 thereabove and is then raised, to be smoothly and easily inserted into the inside of the locking hook 220.

A width of each of the body 100 and the holder 200 may be the same as a width of the peg hook 20.

As illustrated in FIG. 1, by inserting the peg hook 20 into the locking hole of the product 10, the product 10 is held on the peg hook 20, and in this case, the locking hole 10*a* is formed to have the same width as the width of the peg hook 20 so that the product 10 does not shake after the peg hook 20 is inserted thereinto.

Accordingly, when the peg hook label apparatus LB is fixed to the end portion 22 of the peg hook 20 as illustrated in FIG. 7, as the peg hook label apparatus LB should pass through the locking hole 10*a* to hang the product 10 on the peg hook 20, the width of each of the body 100 and the holder 200 is the same as the width of the peg hook 20 so that the width of the peg hook label apparatus LB may be equal to the width of the locking hole 10*a*. Accordingly, the peg hook label apparatus LB may smoothly and easily pass through the locking hole 10*a* of the product 10.

Figure 10:
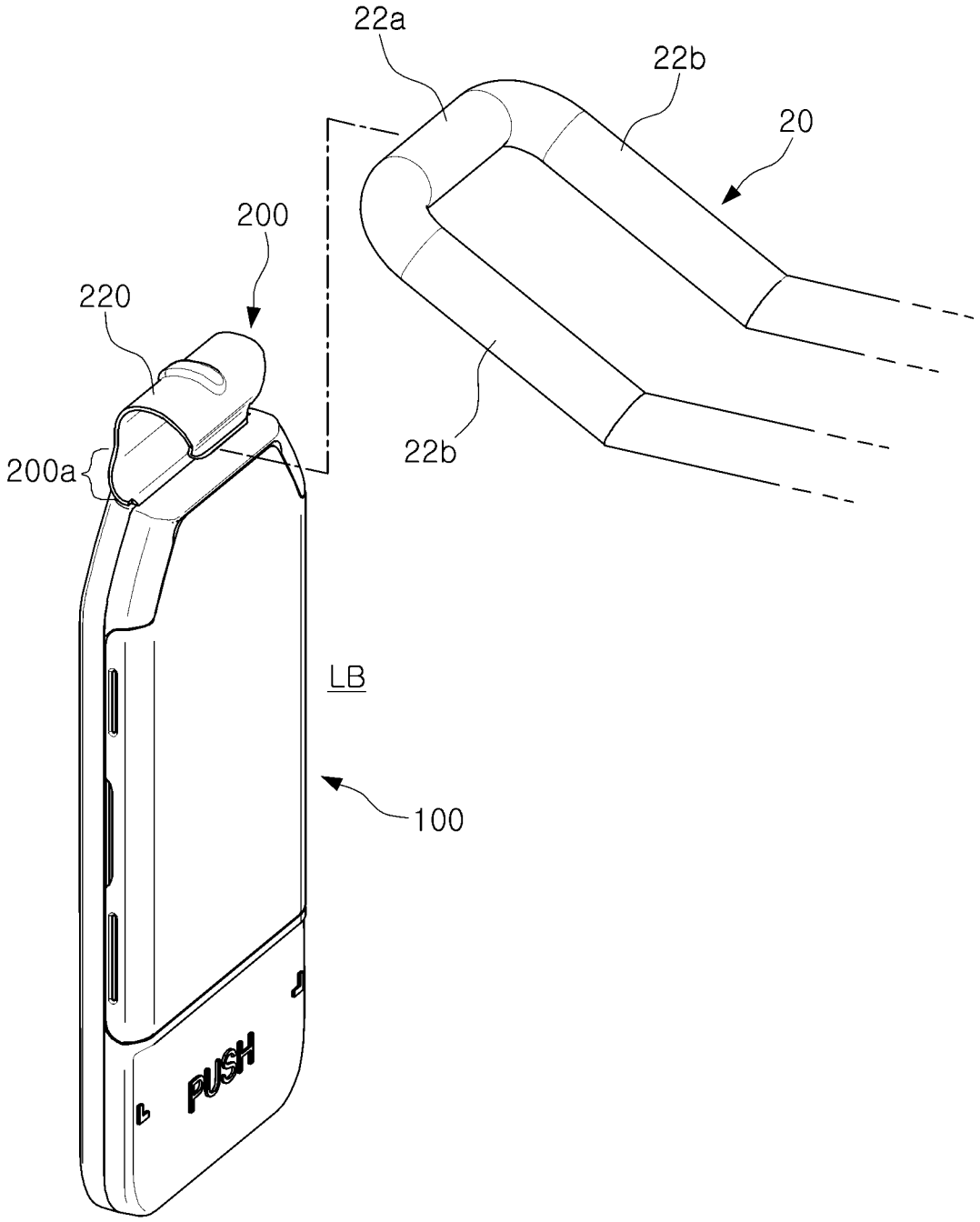
FIG. 10 is a view illustrating a peg hook label apparatus according to another embodiment of the present disclosure.
Figure 11:
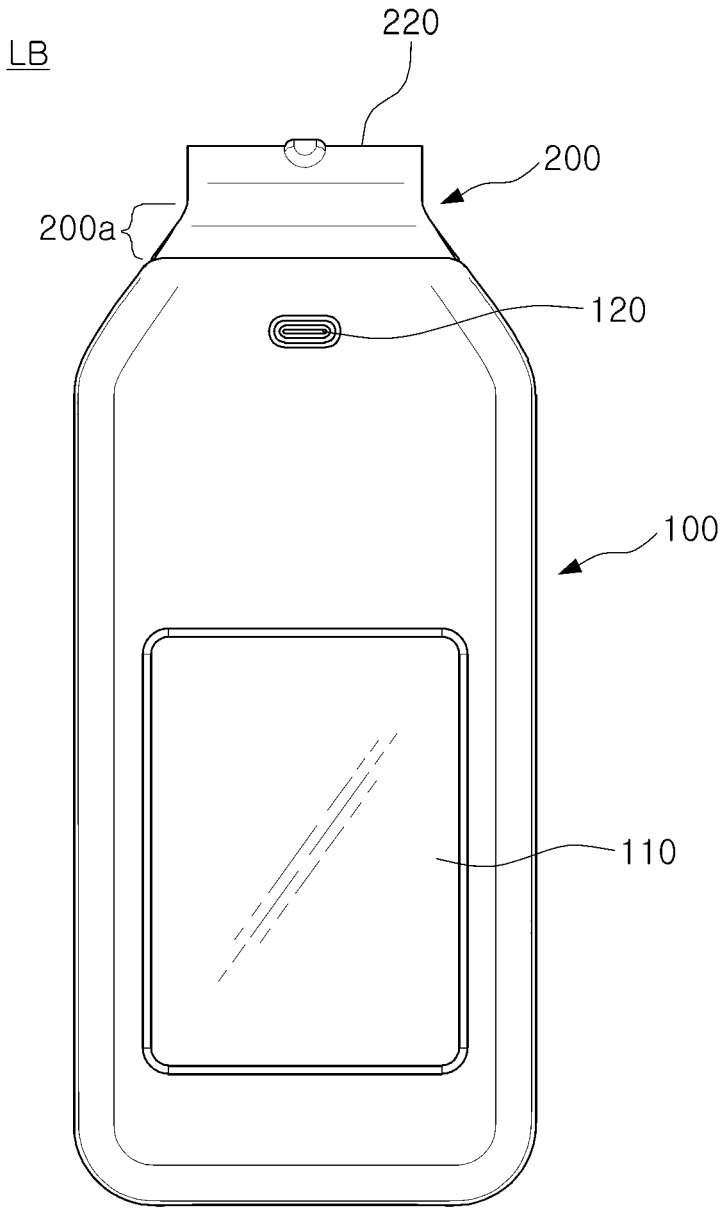
FIGS. 11 and 12 are a front view and a rear view illustrating the peg hook label apparatus of FIG. 10.
Figure 12:
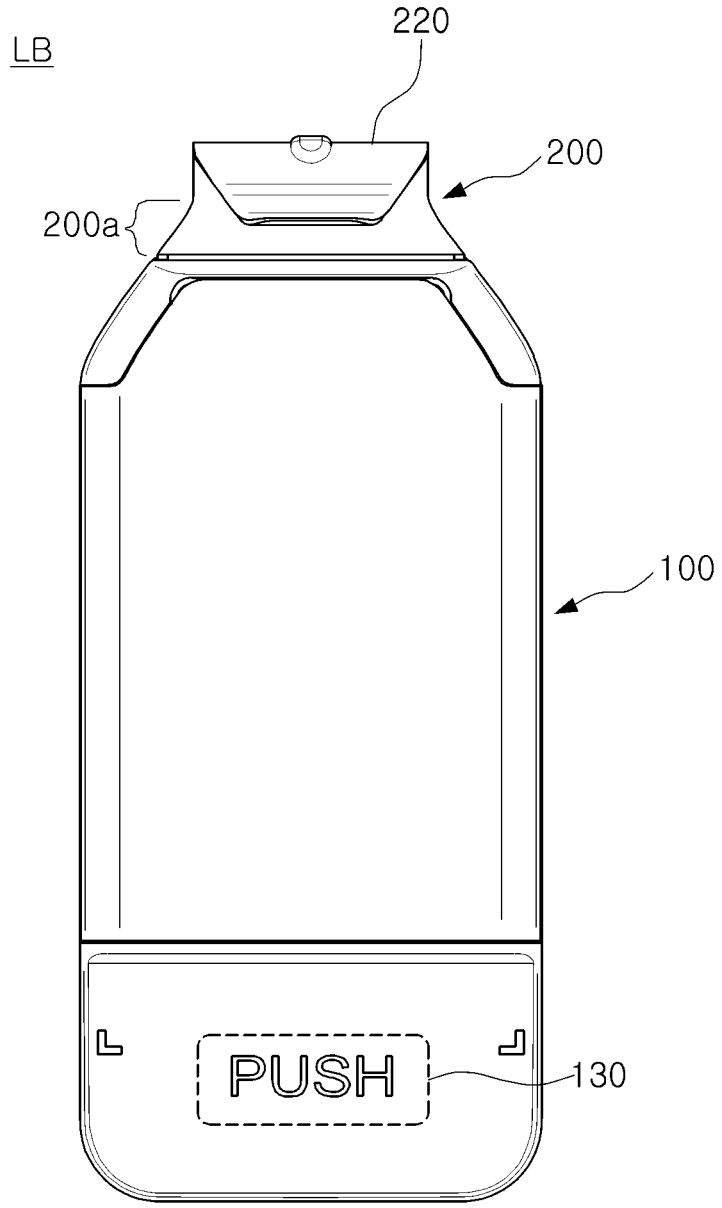
Figure 13:
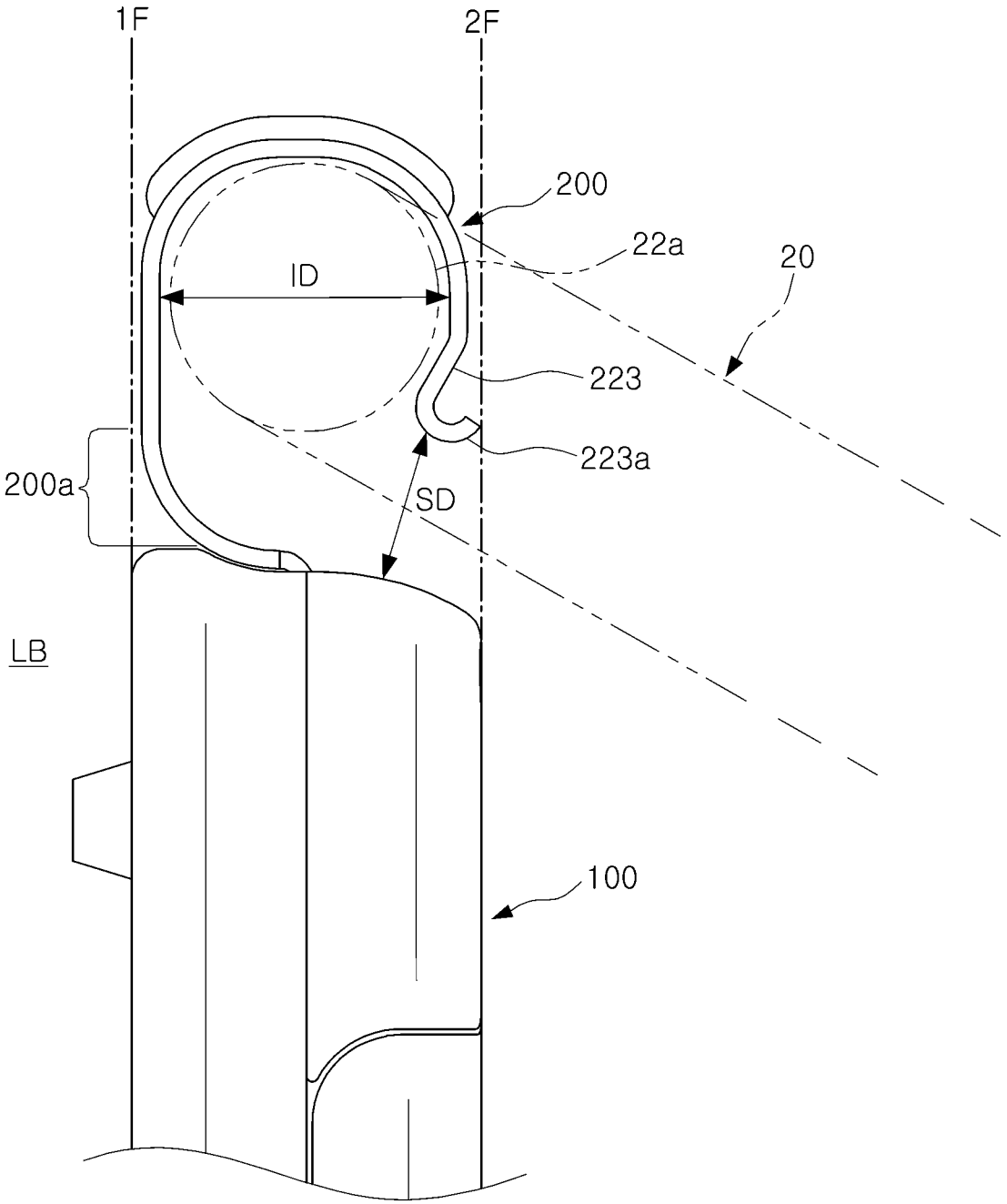
FIG. 13 is an enlarged side view of a holder disposed on an upper portion in the peg hook label apparatus of FIG. 10.

FIG. 10 is a view illustrating a peg hook label apparatus according to another embodiment of the present disclosure, FIGS. 11 and 12 are front and rear views illustrating the peg hook label apparatus of FIG. 10, and FIG. 13 is an enlarged side view of a holder disposed on an upper portion in the peg hook label apparatus of FIG. 10.

Referring to the drawings, a peg hook label apparatus LB according to another embodiment of the present disclosure includes a body 100 and a holder 200.

In this case, since the body 100 is the same as the body (100 in FIGS. 1 to 9) of the peg hook label apparatus, according to the above-described embodiment, a detailed description thereof will be omitted.

In addition, for the function of the holder 200 being installed on the upper portion of the body 100 and caught on the peg hook 20, the holder 200 is also the same as the holder (200 in FIGS. 1 to 9) of the peg hook label apparatus according to the embodiment, and thus, descriptions thereof will be omitted. Structurally different parts thereof will be described in detail as follows.

The holder 200 may include a portion 200*a* connected to the body, and a locking hook 220.

In this case, as illustrated in FIG. 13, the portion 200*a* may have a curved shape while extending from one end of the body 100 toward a virtual first extension surface 1F of one surface of the body 100.

For example, the portion 200*a* connected to the body is disposed upwardly of the upper portion of the body 100, and in detail, is installed on a middle portion of the upper part of the body 100 and has a curved structure while extending toward the virtual first extension surface 1F extending from one surface of the body 100.

In addition, the locking hook 220 may be formed to have a curved shape while extending from the portion 200*a* connected to the body toward a virtual second extension surface 2F of the other surface of the body 100.

For example, the locking hook 220 is connected to the upper end of the portion 200*a* connected to the body, and has a curved structure while extending toward the virtual second extension surface 2F extending from the other surface of the body 100.

As the portion 200*a* connected to the body and the locking hook 220 are configured as described above, when a horizontal bar 22*a* of the peg hook 20 enters the holder 200, the horizontal bar may be smoothly drawn along the curved shape of the portion 200*a* connected to the body and guided toward the locking hook 220. In a state in which the horizontal bar 22*a* of the peg hook 20 is drawn into the locking hook 220, the horizontal bar 22*a* may firmly and stably be held, and rotation of the holder 200 with respect to the horizontal bar 22*a* may also be smoothly performed.

Furthermore, the holder 200 including the portion 200*a* connected to the body and the locking hook 220 may be disposed between the first extension surface 1F and the second extension surface 2F.

Figure 14:
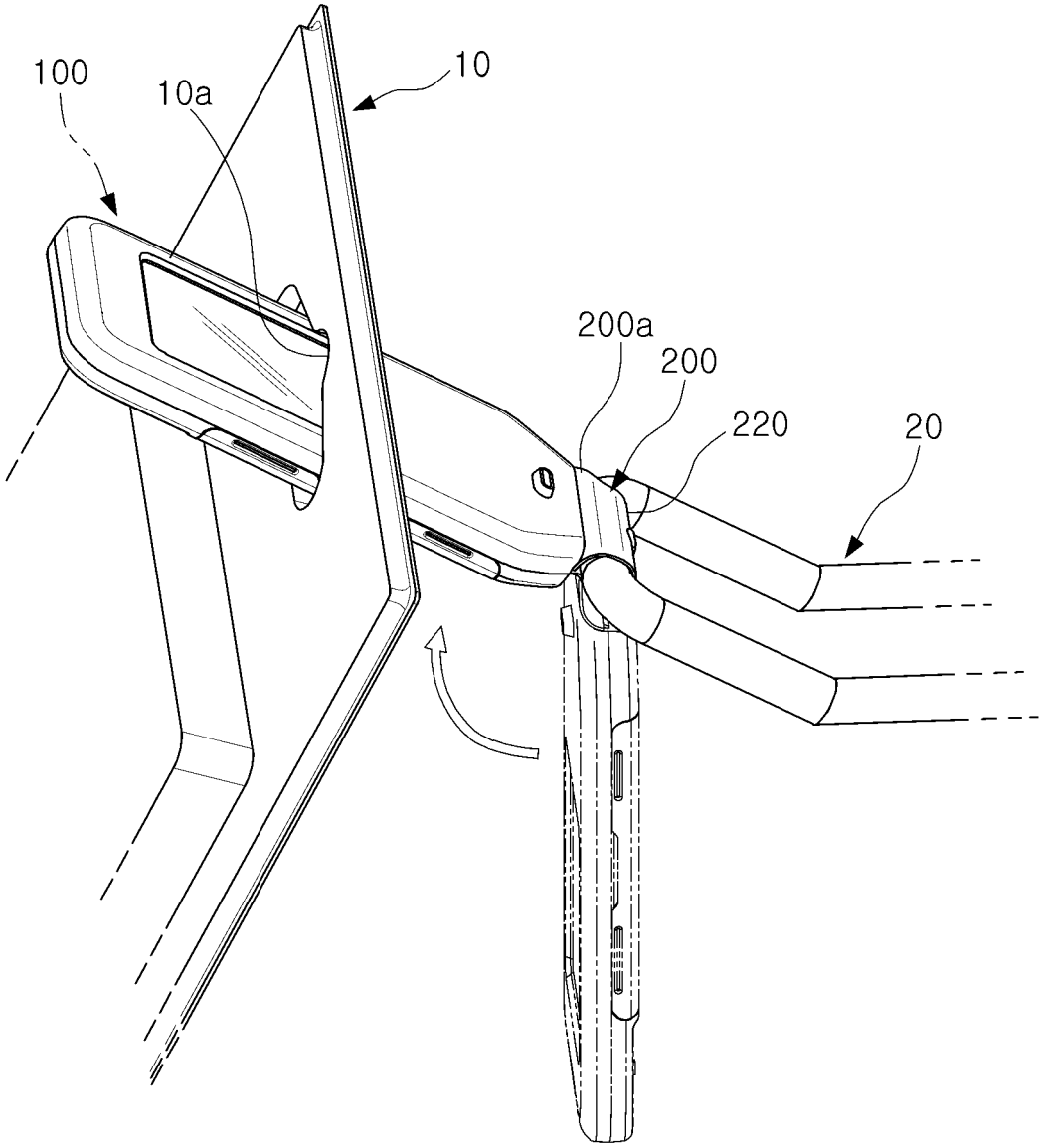
FIG. 14 is a view illustrating that the peg hook label apparatus of FIG. 10 has rotated at the same angle as an inclination of an end portion of a peg hook.

Accordingly, as illustrated in FIG. 14, when the body 100, the holder 200, and the peg hook 20 sequentially or in reverse order pass through a locking hole 10*a* of a product 10, the holder 200 may pass smoothly without being caught in the locking hole 10*a*.

In addition, the locking hook 220 may include a hook end portion 223 bent or curved toward the portion 200*a* connected to the body at the end, and an end extension portion 223*a* curved outwardly from the end of hook end portion 223.

In this case, as an example, the hook end portion 223 has a structure bent toward the portion 200*a* connected to the body as illustrated in the drawing, and thus, after the horizontal bar 22*a* of the peg hook 20 is drawn into the inside of the locking hook 220, the horizontal bar may not easily escape from the looking hook 220.

In this case, the end extension portion 223*a* has a structure bent outwardly from the end of the hook end portion 223, for example, a structure that is extended while being bent to the outside of the locking hook 220 not inwardly thereof. Therefore, when the horizontal bar 22*a* of the peg hook 20 presses the end extension portion 223*a* to enter the inside of the locking hook 220, the horizontal bar may be smoothly entered while sliding on the end extension 223*a*.

In addition, a separation distance SD between the hook end portion 223 and the body 100 may be formed to be less than an inner diameter ID of the locking hook 220.

When the horizontal bar 22*a* of the peg hook 20 is pulled outwardly of the locking hook 220, the horizontal bar is removed through a separation space between the hook end portion 223 of the locking hook 220 and the upper surface of the body 100. As the separation distance SD of this separation space, for example, the separation distance SD between the hook end portion 223 and the body 100 is formed to be smaller than the inner diameter ID of the locking hook 220, the peg hook label apparatus LB may be prevented from being easily separated from the peg hook 20 in a state in which it has rotated upwardly, as illustrated in FIG. 14.

In this specification, the inner diameter ID of the locking hook 200 means twice the radius of curvature with respect to the inner curved surface of the locking hook 220, and the separation distance SD between the hook end portion 223 and the body 100 is formed to be smaller than twice a smallest curvature radius among the radius of curvature with respect to the inner curved surface of the locking hook 220.

Furthermore, the locking hook 220 has a shape curved toward the body while extending from the portion 200*a* connected to the body, and may be formed in such a manner that at least a portion is tapered toward the end as illustrated in FIGS. 10 and 12.

When attaching and detaching the peg hook label apparatus LB to the horizontal bar 22*a* of the peg hook 20, for example, the horizontal bar 22*a* of the peg hook 20 is drawn into the locking hook 220 or drawn from the locking hook 220, the operator works while rotating the peg hook label apparatus LB, so that the locking hook 220 easily interferes, such as colliding with a sidebar 22*b* of the peg hook 20. Thus, a case in which the locking hook 220 and the peg hook 20 may be damaged occurs.

Accordingly, the locking hook 220 may be formed to be tapered toward the end, and thus, when attaching and detaching the peg hook label apparatus LB to and from the peg hook 20, the attachment and detachment operations may be performed smoothly, and the locking hook 220 and the peg hook 20 may be prevented from being damaged.

In an embodiment of the present disclosure, a notification lamp 120 may be further included as illustrated in FIGS. 3 and 11.

The notification lamp 120 is formed on a surface of the body 100 on which the display unit 110 is formed, and is connected to an application through wireless Internet.

This notification lamp 120 serves to notify by light emission when the product 10 held on the peg hook 20 is the product 10 selected in the app.

In an embodiment, a screen switching button 130 may be formed as illustrated in FIGS. 4 and 12.

The display unit 110 is configured to be capable of switching a plurality of screens, and the screen switching button 130 may be formed to operate the screen switching function.

In detail, the screen switching button 130 is formed on the rear side of the display unit 110 in the body 100, and has a structure electrically connected to the display unit 110 to switch the screen of the display unit 110.

Furthermore, this screen switching button 130 may be formed in an embedded structure so as not to protrude to the outside of the body 100, and in this case, the case in which a portion of an outer surface of the body 100, which is a portion corresponding to the screen switching button 130, for example, the portion marked with 'push' is pressed, indicates that the screen switching button 130 is pressed, of course.

As a result, in the case of the peg hook label apparatus LB according to an embodiment, the holder 200 reciprocating toward the peg hook (20) side is configured to be fixed at the same angle as the inclination of the end portion 22 of the peg hook 20 and configured to be released from the fixed position, and the position of the peg hook label apparatus may also be easily fixed to the end portion 22 of the peg hook 20.

In detail, in an embodiment, after the holder 200 is rotated at the same angle as the inclination of the end portion 22 of the peg hook 20, the rotation of the holder 200 may be blocked when the end portion 22 of the peg hook 20 is inserted between the locking plate 210 and the support plate 230. Therefore, in the work of hanging the product 10 on the peg hook 20, the operator may rotate the body 100 and push the body 100 to block the rotation of the peg hook label apparatus LB, and after the work is completed, the operator may pull the body 100 such that the peg hook label apparatus LB may be reversely rotated by the self-weight to be vertically disposed again.

As set forth above, according to an embodiment, by configuring a holder that reciprocates toward the peg hook, such that the position thereof may be fixed at the same angle as an inclination of the end portion of the peg hook and the fixed position may be released, there may be an effect that the position of a peg hook label apparatus may be simply fixed to the end portion of the peg hook.

In detail, according to an embodiment, it is configured that after the holder is rotated at the same angle as the inclination of the end portion of the peg hook, the rotation of the holder may be blocked when the end portion of the peg hook is inserted between the locking plate and the support plate. Therefore, in the work of hanging a product on a peg hook, the operator may rotate a body and push the body to block the rotation of a peg hook label apparatus, and after the work is completed, the operator may pull the body such that the peg hook label apparatus may be reversely rotated by the self-weight to be vertically disposed again.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A peg hook label apparatus comprising:

a body provided with an electronic display unit displaying product information; and a holder provided on one end of the body, the holder comprising:

a portion connected to the body and formed of a locking plate and a support plate which are spaced apart from each other in parallel; and a locking hook extending from an end of the locking plate toward an end of the support plate, wherein the first width of the locking plate and the support plate is formed to be greater than the second width of the locking hook and a width of an inner central hole of the end portion of the peg hook so as to block rotation of the holder when the end portion of the peg hook is inserted between the locking plate and the support plate.

2. The peg hook label apparatus of claim 1, wherein the first width is greater than 1 times the second width and less than or equal to 2 times the second width.

3. The peg hook label apparatus of claim 1, wherein the holder comprises a tapered shape.

4. The peg hook label apparatus of claim 1, wherein the locking hook includes a first portion adjacent to the locking plate and a second portion adjacent to the support plate, the first portion and the second portion are disposed to face each other, and a separation distance between the first portion and the second portion is greater than a separation distance between the locking plate and the support plate.

5. The peg hook label apparatus of claim 1, wherein the locking plate and the support plate are connected to one end of the body, wherein the support plate has a protrusion protruding toward the locking plate, and the locking hook extends from an end of the locking plate toward the protrusion, and is in contact with the protrusion.

6. The peg hook label apparatus of claim 5, wherein an outer surface of the support plate is provided with a guide groove recessed from the outer surface by the protrusion.

7. The peg hook label apparatus of claim 1, wherein the holder further comprises:

an intermediate portion between the portion connected to the body and the locking hook, wherein a side surface of the intermediate portion is inclined by 90 degrees or more and less than 180 degrees with respect to a side surface of the portion connected to the body.

8. The peg hook label apparatus of claim 1, wherein the locking hook comprises a hook end portion bent or curved toward the portion connected to the body at an end, and an end extension portion bent outwardly from an end of the hook end portion.

9. The peg hook label apparatus of claim 1, wherein the locking hook has a shape curved toward the body while extending from the portion connected to the body and has a shape in which at least a portion is tapered toward an end.

10. The peg hook label apparatus of claim 1, further comprising a notification lamp disposed on a surface of the body on which the display unit is disposed, connected to an application via wireless Internet, and notifying by light emission when a displayed product is a product selected by the application.

11. The peg hook label apparatus of claim 1, wherein the display unit is configured to enable a plurality of screens to be switched, and the body is provided with a screen switching button electrically connected to the display unit to switch the plurality of screens of the display unit.

12. A peg hook label apparatus comprising:

a body provided with an electronic display unit displaying product information; and a holder provided on one end of the body, and configured to have a first separation distance between both inner side surfaces of a portion connected to the body, less than a second separation distance between both inner side surfaces of a locking hook disposed on an end thereof, wherein the portion connected to the body is formed of a locking plate and a support plate which are spaced apart from each other in parallel, wherein the first width of the locking plate and the support plate is formed to be greater than the second width of the locking hook and a width of an inner central hole of the end portion of the peg hook so as to block rotation of the holder when the end portion of the peg hook is inserted between the locking plate and the support plate.

13. The peg hook label apparatus of claim 12, wherein the locking plate and the support plate are connected to one end of the body, the support plate has a protrusion protruding toward the locking plate, and the locking hook extends from an end of the locking plate toward the protrusion, and is in contact with the protrusion.

14. The peg hook label apparatus of claim 13, wherein an outer surface of the support plate is provided with a guide groove recessed from the outer surface by the protrusion.

15. The peg hook label apparatus of claim 12, wherein the holder comprises:

an intermediate portion between the portion connected to the body and the locking hook, wherein a side surface of the intermediate portion is inclined by 90 degrees or more and less than 180 degrees with respect to a side surface of the portion connected to the body.

16. A peg hook label apparatus comprising:

a body provided with an electronic display unit displaying product information; and a holder provided on one end of the body, wherein the holder includes:

a locking plate parallel to one surface of the body; and a support plate parallel to the other surface opposing the one surface of the body, at least one of the locking plate and the support plate has a protrusion protruding from an inner surface thereof, wherein the locking plate and the support plate are spaced apart from each other in parallel, wherein the first width of the locking plate and the support plate is formed to be greater than the second width of the locking hook and a width of an inner central hole of the end portion of the peg hook so as to block rotation of the holder when the end portion of the peg hook is inserted between the locking plate and the support plate.

17. The peg hook label apparatus of claim 16, wherein an outer surface of the support plate is provided with a guide groove recessed from the outer surface by the protrusion.

18. The peg hook label apparatus of claim 16, wherein the holder comprises:

an intermediate portion between the portion connected to the body and the locking hook, wherein a side surface of the intermediate portion is inclined by 90 degrees or more and less than 180 degrees with respect to a side surface of the portion connected to the body.

* * * * *